US007922537B2

(12) United States Patent
Chang et al.

(10) Patent No.: US 7,922,537 B2
(45) Date of Patent: Apr. 12, 2011

(54) ELECTRICAL CONNECTOR WITH SHIELDING MEANS FOR GROUNDING AND IMPEDANCE METCHING

(75) Inventors: Yen-Chih Chang, Tu-Cheng (TW); Chun-Fu Lin, Tu-Cheng (TW); Ming-Yue Chen, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/838,513

(22) Filed: Jul. 19, 2010

(65) Prior Publication Data

US 2011/0014814 A1 Jan. 20, 2011

(30) Foreign Application Priority Data

Jul. 17, 2009 (TW) ..... 98213106 U

(51) Int. Cl.
*H01R 13/648* (2006.01)

(52) U.S. Cl. ..... 439/607.57; 439/607.05

(58) Field of Classification Search ..... 439/607.05, 439/607.56, 607.57, 607.58
See application file for complete search history.

(56) References Cited

U.S. PATENT DOCUMENTS 4,724,180 A 2/1988 Kern
6,976,876 B1 * 12/2005 Su et al. ..... 439/607.57
7,470,149 B2 12/2008 Kazama et al.

* cited by examiner

*Primary Examiner* — James Harvey
(74) *Attorney, Agent, or Firm* — Andrew C. Cheng; Wei Te Chung; Ming Chieh Chang

(57) ABSTRACT

An electrical connector (100) comprises an insulative housing (1) defining a number of passageways (10) and shielding holes (14) arranged among the passageways, a conductive covering (5, 6) provided on a top surface of the insulative housing, a dielectric covering (7, 8) provided on a top surface of the conductive covering, a number of electrical contacts (2) receiving in the passageways and comprising a number of signal contacts (22) and grounding contacts (21), and a plurality of conductive elements (3) received in the shielding holes (14) and electrically connected to the grounding contacts (21) through the conductive covering (5, 6), the conductive elements (3) being insulated from the signal contacts (22).

17 Claims, 7 Drawing Sheets

ELECTRICAL CONNECTOR WITH SHIELDING MEANS FOR GROUNDING AND IMPEDANCE METCHING

BACKGROUNDING OF THE INVENTION

1. Field of the Invention

The present invention relates to an electrical connector, and more particularly, to an electrical connector having shielding means for grounding and impedance matching.

2. Description of the Prior Art

An electrical connector disclosed in U.S. Pat. No. 7,470,149 issued to Kazama and Nakayama on Dec. 30, 2008 includes a conductive-contact holder for accommodating at least a signal conductive-contact and a ground conductive-contact. The conductive-contact holder has a holder base formed of a conductive material and includes a first opening for accommodating the signal conductive-contact and a second opening for accommodating the ground conductive-contact. However, signal interference from external systems and cross talks between the conductive-contacts have influence to signal transmission particularly while transmitting signal with high rate.

In view of the above, an improved electrical connector that overcomes the above-mentioned disadvantages is desired.

SUMMARY OF THE INVENTION

Accordingly, an object of the present invention is to provide an electrical connector which has shielding holes forming a shielding mash.

To fulfill the above-mentioned object, an electrical connector comprises an insulative housing defining a plurality of passageways and shielding holes arranged among the passageways, a conductive covering provided on a top surface of the insulative housing, a dielectric covering provided on a top surface of the conductive covering, a plurality of electrical contacts receiving in the passageways and comprising a plurality of signal contacts and grounding contacts, and a plurality of conductive elements received in the shielding holes and electrically connected to the grounding contacts through the conductive covering, the conductive elements being insulated from the signal contacts.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
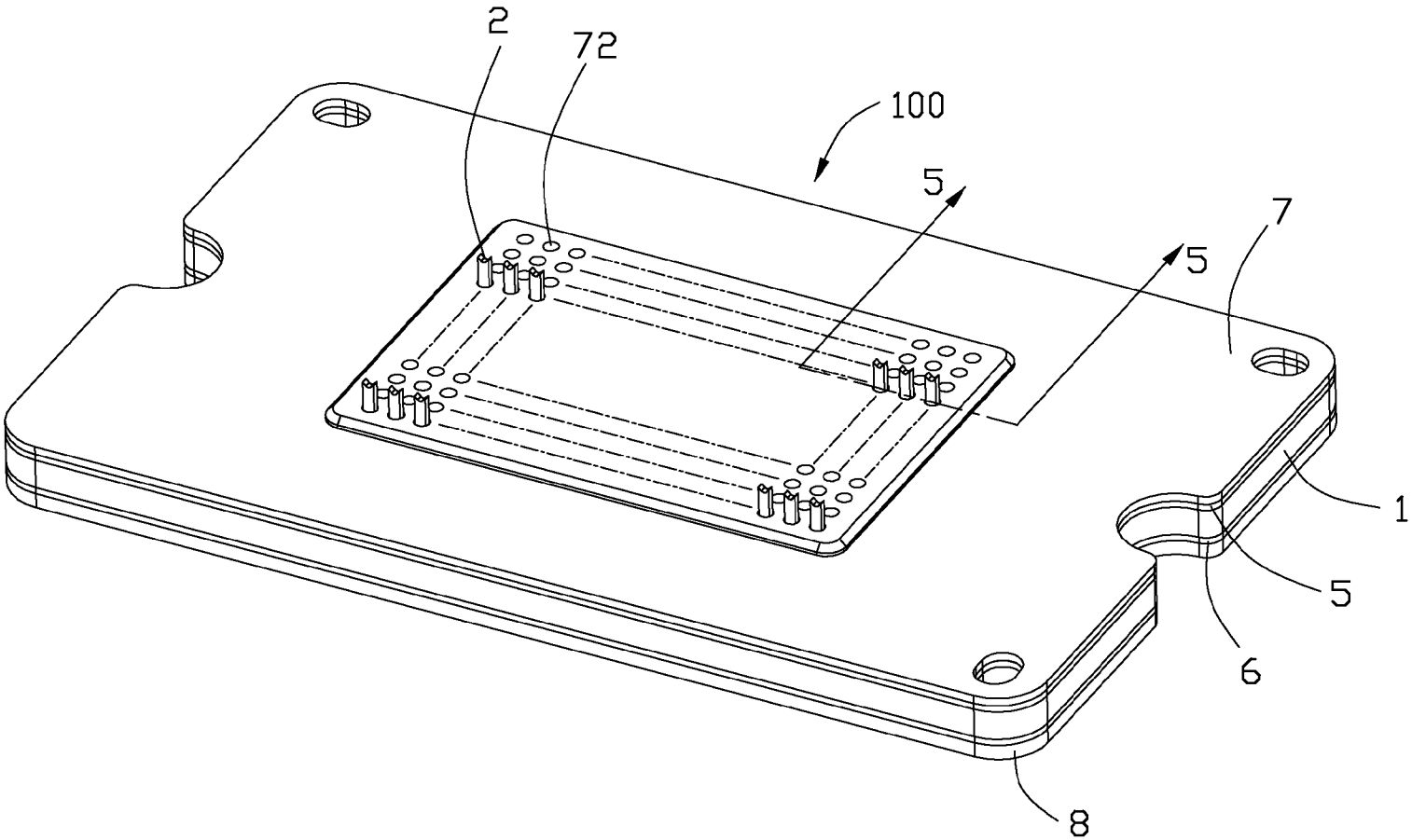
FIG. 1 is an assembled, perspective view of an electrical connector in accordance with a preferred embodiment of the present invention.
Figure 2:
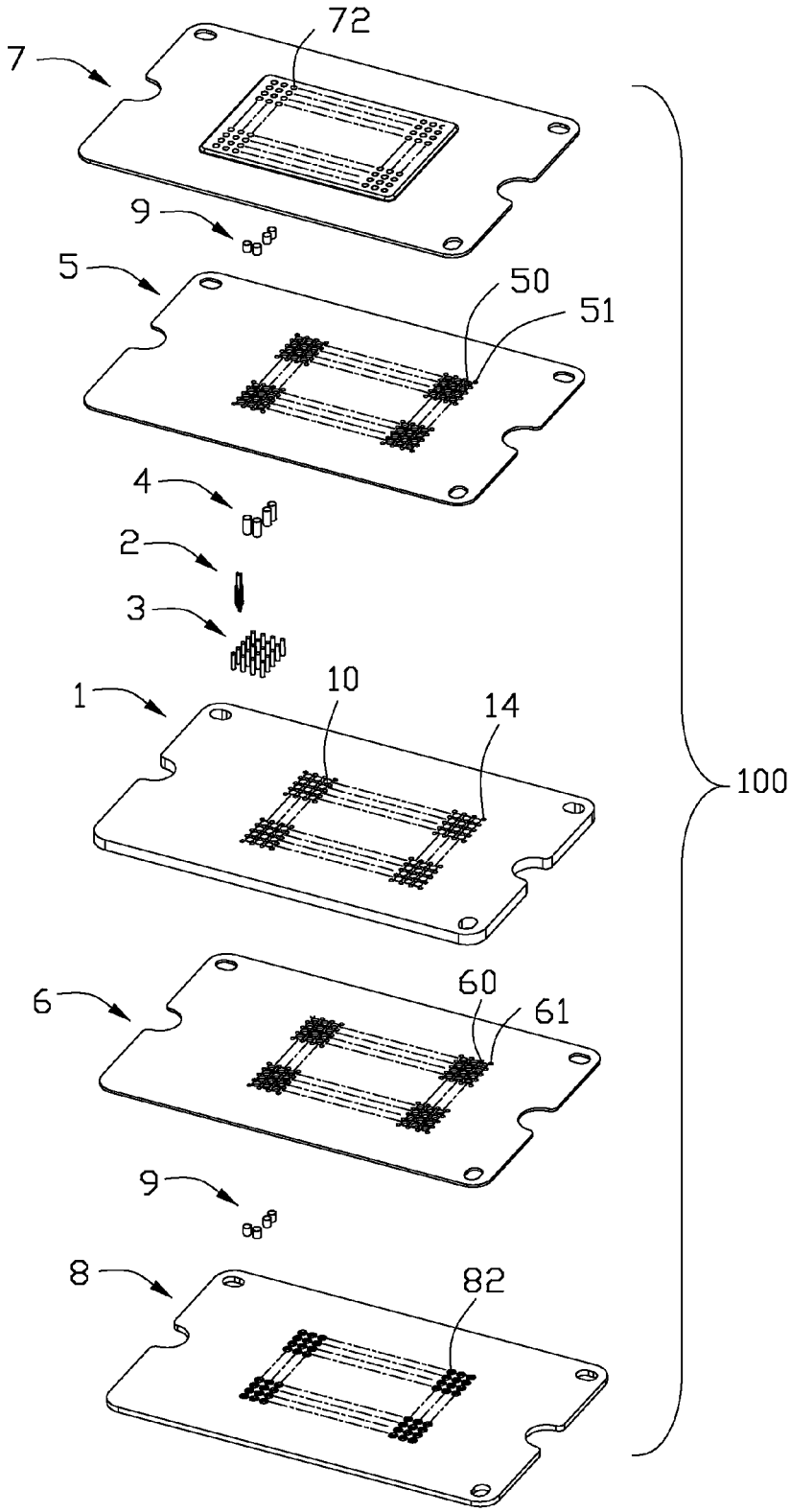
FIG. 2 is an exploded, perspective view of the electrical connector shown in FIG. 1.
Figure 3:
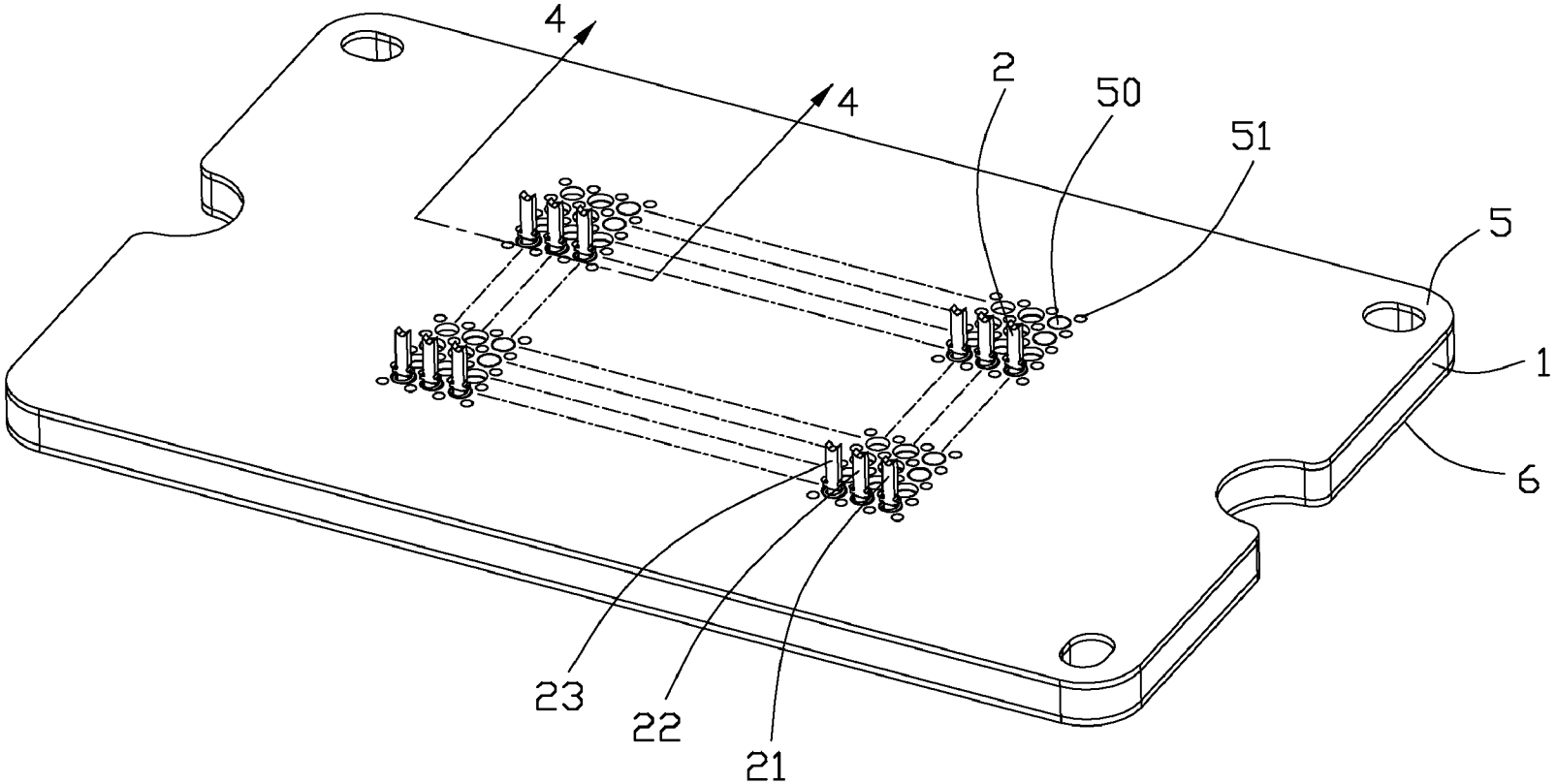
FIG. 3 is an assembled, perspective view of the electrical connector showing a pair of conductive coverings removed therefrom.
Figure 4:
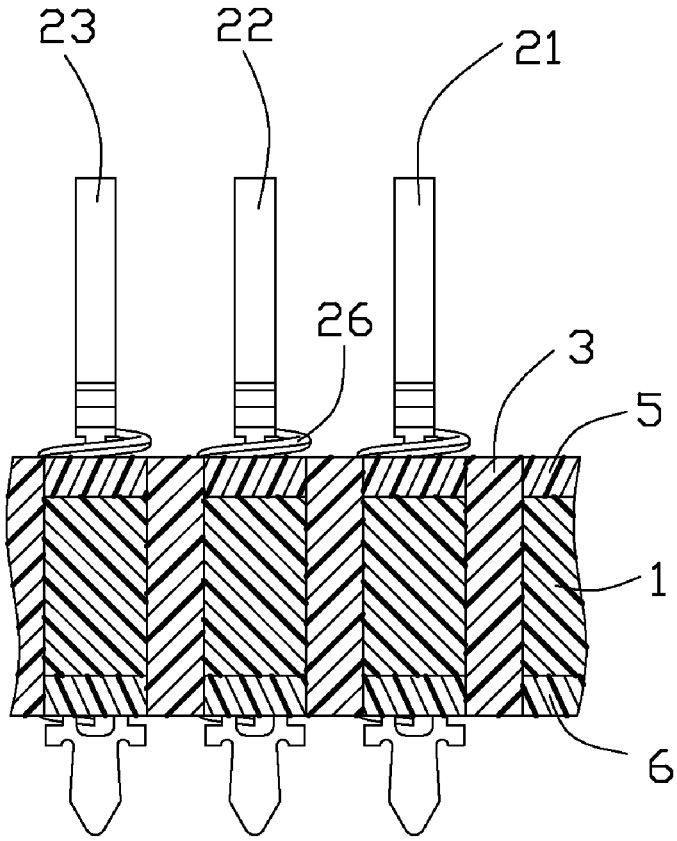
FIG. 4 is a cross sectional view taking along line 4-4 shown in FIG. 3.

Referring to FIGS. 1 and 2, an electrical connector 100 for electrically connecting an electronic package (not shown), such as a central processing unit (CPU), with a circuit substrate (not shown), such as a printed circuit board (PCB) comprises an insulative housing 1 defining a plurality of passageways 10, a plurality of electrical contacts 2 receiving in the passageways 10, a pair of conductive coverings 5, 6 provided on opposite surfaces of the insulative housing 1 and a pair of dielectric coverings 7, 8 provided on outer surfaces of the conductive coverings 5, 6.

Referring to FIGS. 2 to 5, the planar insulative housing 1 is made of plastic and defines a plurality of shielding holes 14 arranged among the passageways 10 with conductive elements therein. In this embodiment, the conductive elements are metal posts 3 filled in the shielding holes 14. The metal posts 3 are arranged among the electrical contacts 2. The diameter of the shielding hole 14 is less than that of the passageway 10.

The conductive coverings 5, 6 are made of electrically conductive material and the dielectric coverings 7, 8 are made of nonconductive material for insulating the conductive coverings 5, 6 from external systems. The conductive coverings 5, 6 both define a plurality of post receiving holes 51, 61 corresponding to the shielding holes 14 of the insulative housing 1 for receiving opposite ends of the metal posts 3 therein, and a plurality of contact receiving holes 50, 60 corresponding to the passageways 10 of the insulative housing 1. The dielectric coverings 7, 8 both define a plurality of openings 72, 82 corresponding to the contact receiving holes 50, 60 of the conductive coverings 5, 6. The electrical contacts 2 extend through the contact receiving holes 50, 60 and the openings 72, 82.

The upper conductive covering 5 is assembled on top surface of the insulative housing 1 and the lower conductive covering 6 is assembled on bottom surface of the insulative housing 1. The upper dielectric covering 7 is located on the upper conductive covering 5 and the lower dielectric covering 8 is located under the lower conductive covering 6.

Figure 5:
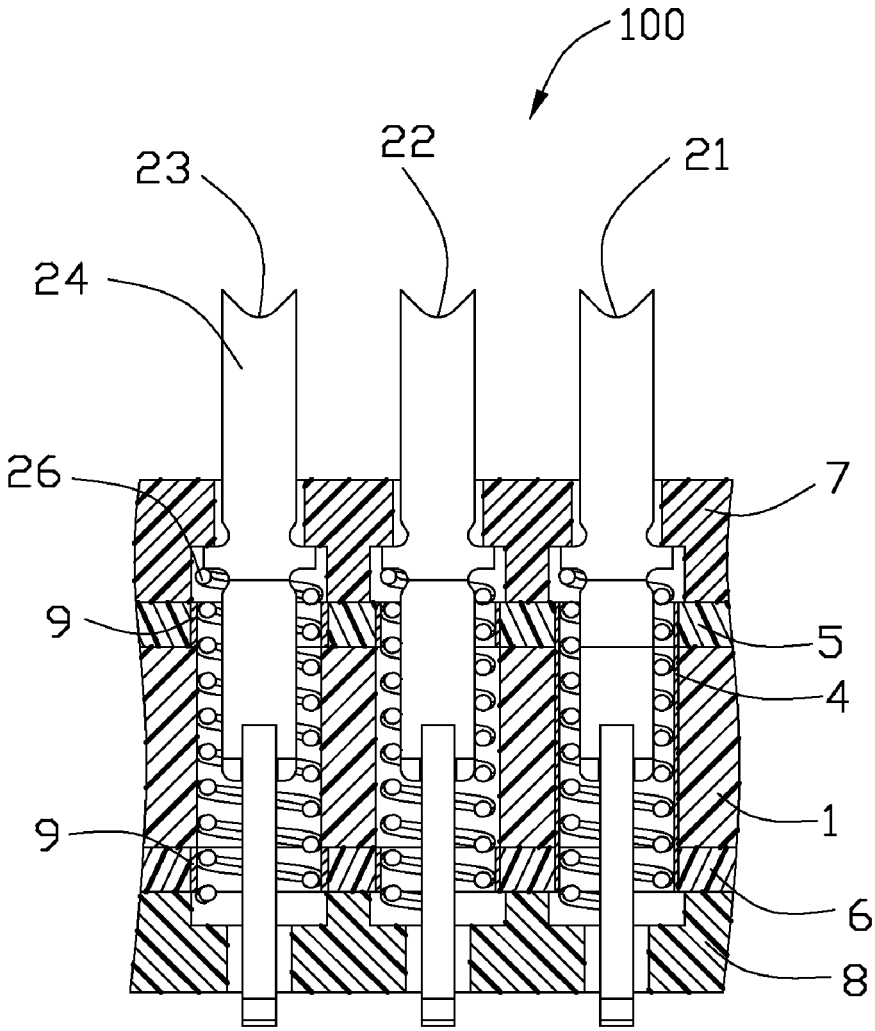
FIG. 5 is a cross sectional view taking along line 5-5 shown in FIG. 1.
Figure 6:
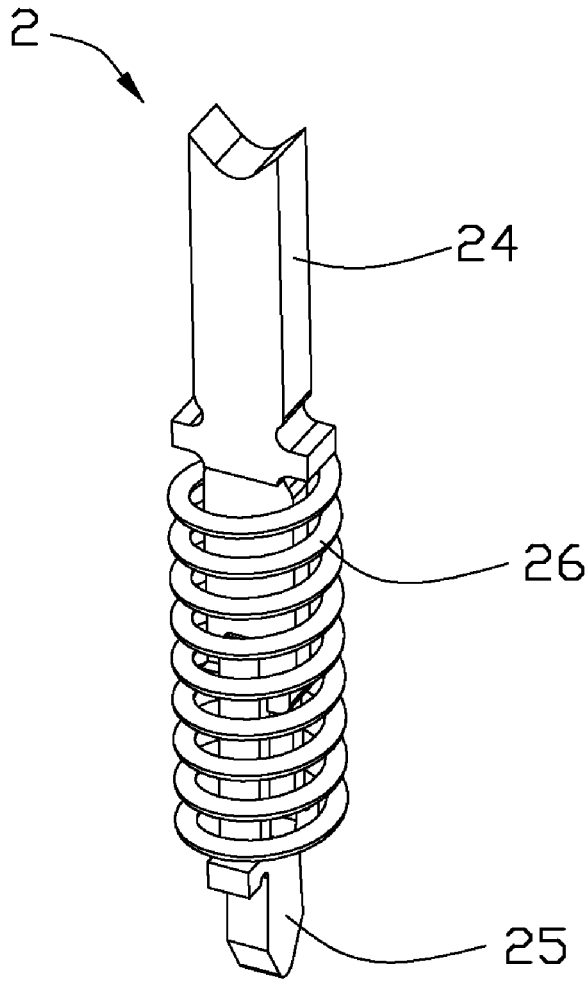
FIG. 6 is an assembled, perspective view of an electrical contact of the electrical connector.
Figure 7:
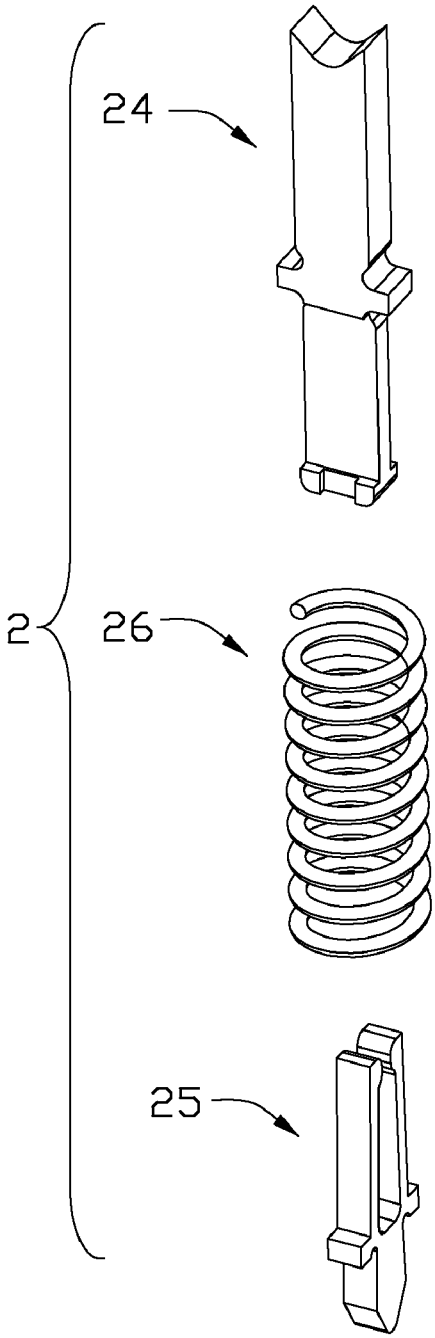
FIG. 7 is an exploded, perspective view of the electrical contact shown in FIG. 6.

Referring to FIGS. 5 to 7, the electrical contacts 2 are received in the passageways 10, contact receiving holes 50, 60 and the openings 72, 82 and each has a first terminal 24, a second terminal 25 connecting with the first terminal 24 and a spring 26 surrounding the first and second terminal 24, 25. The electrical contacts 2 include grounding contacts 21 for supplying a ground potential, signal contacts 22 for performing input and output of a signal and power contacts 23 for supplying a power potential. The grounding contacts 21 are electrically connected with the conductive coverings 5, 6 by means of metal sleeves 4, specifically, each of the grounding contacts 21 is wrapped by the metal sleeve 4 which electrically connect the grounding contact 21 to the conductive coverings 5, 6. The signal contacts 22 and power contacts 23 are isolated to the conductive coverings 5, 6 by means of insulative tubes 9 provided between the conductive coverings 5, 6 and the signal and power contacts 22, 23.

Referring to FIGS. 2 to 5, the cylindrical metal posts 3 are formed of electrically conductive material. The metal posts 3 are inserted in the shielding holes 14 and the post receiving holes 51, 61, and are sandwiched between two dielectric coverings 7, 8. The metal posts 3 are arranged among the electrical contacts 2 and electrically connected to the conductive coverings 5, 6, so that the metal posts 3 and the grounding contacts 21 are electrically interconnected by the conductive coverings 5, 6, then they are grounded thus forming a shielding mash. As a result, signal interference from external systems and cross talks between the electrical contacts 2 are reduced. Moreover, capacitance and inductance between the signal contacts 22 are changed and then impedance therebetween can be close to 50Ω, to facilitate transmitting high speed signals.

In this embodiment, the conductive coverings 5, 6 are conductive boards assembled on the insulative housing 1 and the dielectric coverings 7, 8 are dielectric boards assembled on the conductive coverings 5, 6. In an alternative embodiment of the present invention, the conductive coverings 5, 6 also could be conductive coatings plated on the insulative housing 1 and the dielectric coverings 7, 8 are dielectric coatings plated on the conductive coverings 5, 6. Additionally, the conductive elements are metal shielding coatings plated on inner surfaces of the shielding holes 14. Conductive metal films are plated on inner walls of the passageways 10 which receive the grounding contacts 21 therein. The conductive metal films replace the metal sleeves 4 to electrically connect the grounding contacts 21 and the conductive covering 5, 6.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

an insulative housing defining a plurality of passageways and shielding holes arranged among the passageways;

a conductive covering provided on a top surface of the insulative housing;

a dielectric covering provided on a top surface of the conductive covering;

a plurality of electrical contacts receiving in the passageways and comprising a plurality of signal contacts and grounding contacts; and a plurality of conductive elements received in the shielding holes and electrically connected to the grounding contacts through the conductive covering, said conductive elements being insulated from the signal contacts.

2. The electrical connector as claimed in claim 1, wherein said conductive elements are metal coatings plated on inner surfaces of the shielding holes.

3. The electrical connector as claimed in claim 1, wherein said conductive covering is a conductive board assembled on the insulative housing or a conductive coating plated on the insulative housing.

4. The electrical connector as claimed in claim 1, wherein said dielectric covering is a dielectric board assembled on the conductive covering or a dielectric coating plated on the conductive covering.

5. The electrical connector as claimed in claim 1, wherein the grounding contacts are wrapped by metal sleeves connected to the conductive covering.

6. The electrical connector as claimed in claim 1, wherein inner walls of the passageways receiving the grounding contacts therein are plated with conductive metal films electrically connecting the grounding contacts to the conductive covering.

7. The electrical connector as claimed in claim 1, wherein a plurality of insulative tubes are provided between the conductive covering and each of the signal and power contacts.

8. The electrical connector as claimed in claim 1, wherein the electrical connector further comprises another conductive covering on a bottom surface of the insulative housing and another dielectric covering on a bottom surface of said another conductive covering.

9. The electrical connector as claimed in claim 1, wherein the diameter of the shielding hole is less than that of the passageway.

10. An electrical connector comprising:

an insulative housing defining a plurality of passageways and shielding holes arranged among the passageways;

a plurality of electrical contacts receiving in the passageways and comprising a plurality of signal contacts and grounding contacts;

a plurality of metal posts filled in the shielding holes and electrically connected with the grounding contacts; and a pair of conductive coverings provided on opposite surfaces of the insulative housing and electrically connecting the metal posts and the grounding contacts, said signal and grounding contacts projecting out the conductive coverings while said metal posts are located within the pair of conductive coverings.

11. The electrical connector as claimed in claim 10, wherein said conductive coverings are conductive boards assembled on the insulative housing or conductive coatings plated on the insulative housing.

12. The electrical connector as claimed in claim 10, wherein a pair of dielectric coverings are located on outer surfaces of the conductive coverings.

13. The electrical connector as claimed in claim 12, wherein said dielectric coverings are dielectric boards assembled on the conductive coverings or dielectric coatings plated on the conductive coverings.

14. The electrical connector as claimed in claim 12, wherein the metal posts are sandwiched between the dielectric coverings.

15. The electrical connector as claimed in claim 10, wherein a plurality of insulative tubes are provided between the conductive coverings and each of the signal and power contacts.

16. An electrical connector comprising:

an insulative housing defining a plurality of passageways and shielding holes arranged among the passageways;

an interior covering provided on a top surface of the insulative housing;

an exterior covering provided on a top surface of the conductive covering;

a plurality of electrical contacts receiving in the passageways and comprising a plurality of signal contacts and grounding contacts; and a plurality of conductive elements received in the shielding holes and electrically connected to the grounding contacts via conductive paths provided by the exterior covering, said conductive elements being insulated from the signal contacts.

17. The electrical connector as claimed in claim 16, wherein the whole exterior covering is conductive.

* * * * *